US005950534A

United States Patent [19]

Philipp

[11] Patent Number: 5,950,534

[45] **Date of Patent: *Sep. 14, 1999**

[54] INK DABBER PRINTING PRESS

[75] Inventor: Wilfried Philipp, Kornwestheim, Germany

[73] Assignee: Tampoprint GmbH, Korntal-Munchingen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,769

[22] Filed: Jul. 28, 1997

[30] Foreign Application Priority Data

Aug. 30, 1996 [DE] Germany ..... 296 15 092 U

[51] Int. Cl.[6] ..... B41F 1/00

[52] U.S. Cl. ..... 101/41; 101/163

[58] Field of Search ..... 101/35, 41, 42, 101/43, 44, 150, 163, 167, 169, 170

[56] References Cited

U.S. PATENT DOCUMENTS 5,653,167 8/1997 De Volder ..... 101/41

FOREIGN PATENT DOCUMENTS 1070192 12/1959 Germany ..... 101/41
2334179 1/1975 Germany ..... 101/41
1266751 10/1986 Russian Federation ..... 101/41

*Primary Examiner*—Edgar Burr
*Assistant Examiner*—Amanda B. Sandusky
*Attorney, Agent, or Firm*—Jones, Tullar & Cooper, P.C.

[57] ABSTRACT

An ink dabber printing press including a printing device, an ink dabber mounted to the printing device, and structure for changing the printing position so that different size objects to be printed can be accommodated.

11 Claims, 7 Drawing Sheets

INK DABBER PRINTING PRESS

FIELD OF THE INVENTION

The present invention relates to an ink dabber printing press with an ink dabber maintained on a printing device, the ink dabber being moved for printing by the printing device into a printing position.

BACKGROUND OF THE INVENTION

An ink dabber printing press of this type is known from European Patent Publication EP 0 474 262 B1. The ink dabber is a fastened on a rod, which can be moved back and forth in an approximately vertical direction. The rod is connected with a lever which is pivotably seated in the interior of the ink dabber printing press. This lever is coupled by means of two arms with a rotatable cam disk, which is driven by a motor or the like. Rotation of the cam disk causes pivoted movement of the lever, which in turn results in an up and down movement of the rod and thus of the ink dabber.

The movement of the ink dabber by means of the cam disk takes approximately the following course during the printing process. Initially, the ink dabber moves from an upper position downward into an ink pickup position, in which the ink dabber is placed on an advanced printing block which has the engraving. Thereafter the ink dabber is lifted off the printing block upward and the printing block is retracted. Now the ink dabber again moves downward into the printing position, i.e. into a position in which the ink lifted off the etching is transferred to the object to be printed. This printing position is exactly defined, in particular in the vertical direction, by the structural design of the ink dabber printing press. The object to be printed is arranged, for example with the aid of a holder or the like, and the ink dabber now is placed on it. By means of this the print image is transferred to the object to be printed and the ink dabber again moves upward into the position of rest. With this the printing process is terminated.

Customarily a plurality of like objects to be printed are sequentially brought to the ink dabber printing press with the aid of a conveyor belt or the like. In this case the objects are placed on holders of the same type, which are all adjusted with respect to the course of the movement of the ink dabber in such a way that the objects are in the correct printing position or at the printing height when the ink dabber is placed on them.

If different objects are now to be printed, which have a differing size or shape, in particular in the vertical direction, from the previously printed objects, this results in the new objects placed on the holders not being in the correct printing position anymore, i.e. they take up a different printing height. So that the print image can be transferred to the objects, it is necessary to adjust the new objects, in particular in the vertical direction, to the correct printing position. This is achieved in that all holders on which the new objects to be printed have been placed are freshly adjusted. Because of the multitude of the holders this represents a large outlay. It might even be necessary to employ new holders.

OBJECT AND SUMMARY OF THE INVENTION

It is the object of the present invention to provide an ink dabber printing press wherein a change of objects to be printed can be performed quickly and without a large effort.

In accordance with the present invention this object is attained in connection with an ink dabber printing press of the kind mentioned at the outset in that the printing device is provided with means for changing the printing position.

Therefore all holders are no longer newly adjusted in case of a change of the objects to be printed. The printing position of the ink dabber is changed instead. The new objects to be printed are therefore placed on the unchanged holders and the printing position of the ink dabber is matched to the size and shape of the new objects. For example, if the new objects are taller than the previous objects, the printing position of the ink dabber is correspondingly changed upward. This results in the new objects being in the correct printing position when the ink dabber is placed on them. The printing position of the ink dabber can be correspondingly matched to smaller objects without problems.

The change in the printing position in this case is clearly connected with considerably less effort than the changing in the position of all holders on the conveyor belt. In this way it is possible to perform a change between different objects to be printed with considerably less effort and therefore considerably faster. The ink dabber printing press in accordance with the present invention can therefore be employed considerably more cost-efficiently and at the same time more flexibly than before.

In an advantageous embodiment, the printing device has a pivotable drive lever, which is coupled with a drivable cam disk, wherein the means for changing the printing position has a setting lever, which is pivotably seated on the drive lever and is coupled with a rod which can be moved back and forth and on which the ink dabber is fastened.

In contrast to the prior art, the setting lever is located between the drive lever of the printing device and the rod provided with the ink dabber. This setting lever and the drive lever can be considered to be parts of a lever system which can be changed by pivoting the setting lever. If the setting lever remains unchanged with respect to the drive lever, the setting lever represents a straight-line extension of the drive lever, for example, and the geometry of the lever system and therefore the printing position of the ink dabber also remain unchanged. However, if the angle of the setting lever is changed with respect to the drive lever, i.e. if the setting lever is angled off in one direction, for example, the geometry of the lever system is changed thereby. This change of the lever system itself results in a change of the printing position of the ink dabber. In this way it is possible to change the printing position of the ink dabber upward or downward by pivoting the setting lever in the one or the other direction.

With the aid of the setting lever arranged between the drive lever and the rod it is therefore possible to change the printing position of the ink dabber. This represents a simple and cost-effective way of realizing the change of the printing position.

In this connection there are various possibilities for affecting the setting lever for the purpose of a change in the printing position. With a simple embodiment it is for example possible to set the setting lever fixedly at a defined angle with respect to the drive lever. This has the result that not only the printing position, but also the ink pickup position and the upper position of the ink dabber are changed.

In contrast to this, in an advantageous further development of the present invention the means for changing the printing position have a setting track, wherein the setting lever has an arm which is coupled with the setting track.

It is possible with the aid of the setting track to vary the angle between the setting lever and the drive lever in the course of a printing process. The setting track is designed with respect to the upper position and the ink pickup position of the ink dabber in such a way that the setting lever and the drive lever remain unchanged in relation to each other. Therefore the upper position (position of rest) and the ink pickup position of the ink dabber remain unchanged. However, in the area of the printing position of the ink dabber, the angle between the setting lever and the drive lever is changed by means of an appropriate course of the setting track. This then causes a change in the printing position of the ink dabber.

It is therefore possible to directly change the angle between the setting lever and the drive lever as a function of the course of the setting track. Thus the setting track represents a simple and cost-effective option for changing the printing position of the ink dabber without also changing the upper position and the ink pickup position of the ink dabber in the process.

In an advantageous further development of the present invention the setting track has a circular segment with a first radius, as well as a curved section adjoining the circular segment and makes a transition from the first radius to a second radius, the second radius being variable.

The circular segment represents the section of the setting track which influences the upper position and the ink pickup position of the ink dabber. With respect to this the adjoining curved section is assigned to the printing position of the ink dabber. In this case the transition in the curved section from the first radius to the second radius results in a pivoting of the setting lever and therefore a change in the printing position of the ink dabber.

By means of the division into two sections it is therefore achieved in a simple manner that only the printing position of the ink dabber is affected, namely by means of the curved section. The change in the printing position per se is caused in a simple manner by the curvature of this curved section.

In an advantageous further development of the present invention the circular segment is disposed concentrically with respect to the pivot axis of the lever, and the second radius is less than the first radius.

The concentric arrangement of the circular segment results in the upper position and the ink pickup position of the ink dabber not being changed by the setting track. The reduction of the radius of the curved section from the first radius to the second radius causes pivoting of the setting lever in such a way that the printing position of the ink dabber is changed in the direction toward a higher position. If the second radius is selected to be greater than the first radius, this results in a change of the printing position in the direction toward a lower position.

As a whole, the displacement of the setting lever is solely affected by the design of the setting track, in particular by its division into two sections, and the course of the setting track in these sections. This in turn results in a change of the printing position of the ink dabber.

In an advantageous embodiment of the present invention, the means for changing the printing position has a plate which is provided with the setting track. The plate represents a simple and cost-effective component, by means of which the setting track can be realized. In this case it is possible to provide different plates with differing setting tracks.

The plate in an advantageous embodiment of the present invention is displaceably held in a holding device which is fixed in place.

It is possible because of the displaceability of the plate to achieve the various printing positions of the ink dabber with only a single plate. Here the displacement of the plate causes a change of the setting track and thus a change in the printing position of the ink dabber. Thus the exchange of different plates is replaced by the displacement of only a single plate. This also therefore represents a further simplification of the ink dabber printing press.

At least one displacement track, which is coupled with the plate, is provided in the holding device of an advantageous further development of the present invention.

The manner in which the plate, and therefore the setting track, can be displaced is fixed by means of the displacement track in the plate. Thus, the setting track and the displacement track together affect the maintenance of the angle between the setting lever and the drive lever. It is therefore necessary to match the displacement track and the setting track to each other with respect to the desired displacement of the setting lever and therefore the desired change of the printing position of the ink dabber. Following such a setting it is possible to achieve a displacement of the setting track and therefore a change of the printing position of the ink dabber by means of a simple and quick displacement of the plate along the displacement track.

In another advantageous further development of the present invention the displacement track has a circular segment which is arranged concentrically in relation to the pivot axis of the drive lever.

By means of the concentric arrangement of the circular segment it is achieved that the displacement track as such has no effect on the setting lever. Because of the displacement of the setting lever caused by the displacement of the setting track, a displacement of the plate only indirectly also results in a displacement of the printing position. Therefore the change of the printing position is no longer dependent on the cooperation between the setting track and the displacement track, but only on the setting track alone. This makes the production and design of the setting track easier.

In an advantageous embodiment of the present invention a displacement device fixed in place is provided, by means of which the plate can be displaced in relation to the holding device.

A simple and clear setting of the desired angle of the setting lever and therefore of the desired printing position of the ink dabber becomes possible for a user of the ink dabber printing press with the aid of the displacement device. The setting does not require special tools or the like, but instead can be easily performed by the user at the displacement device.

The displacement device is provided with a graduation in an advantageous further development of the present invention.

This makes it possible for the user to read a value off the graduation which corresponds to the set desired printing position of the ink dabber. At a later time the user then can again set this value, and with it the same desired printing position, on the displacement device with the aid of the graduation. Therefore the graduation provides the possibility of a reproducibility of the setting of defined printing positions of the ink dabber. The value advantageously represents the actual printing position.

Further advantages, characteristics and details of the present invention ensue from the following description of particularly preferred exemplary embodiments of the present invention, which are represented in the drawings. The characteristics represented in the drawings or mentioned in the specification or the claims can be essential for the present invention here either individually by themselves or in any arbitrary combination.

DETAILED DESCRIPTION OF THE PREFERRED EMBODIMENTS

Figure 1:
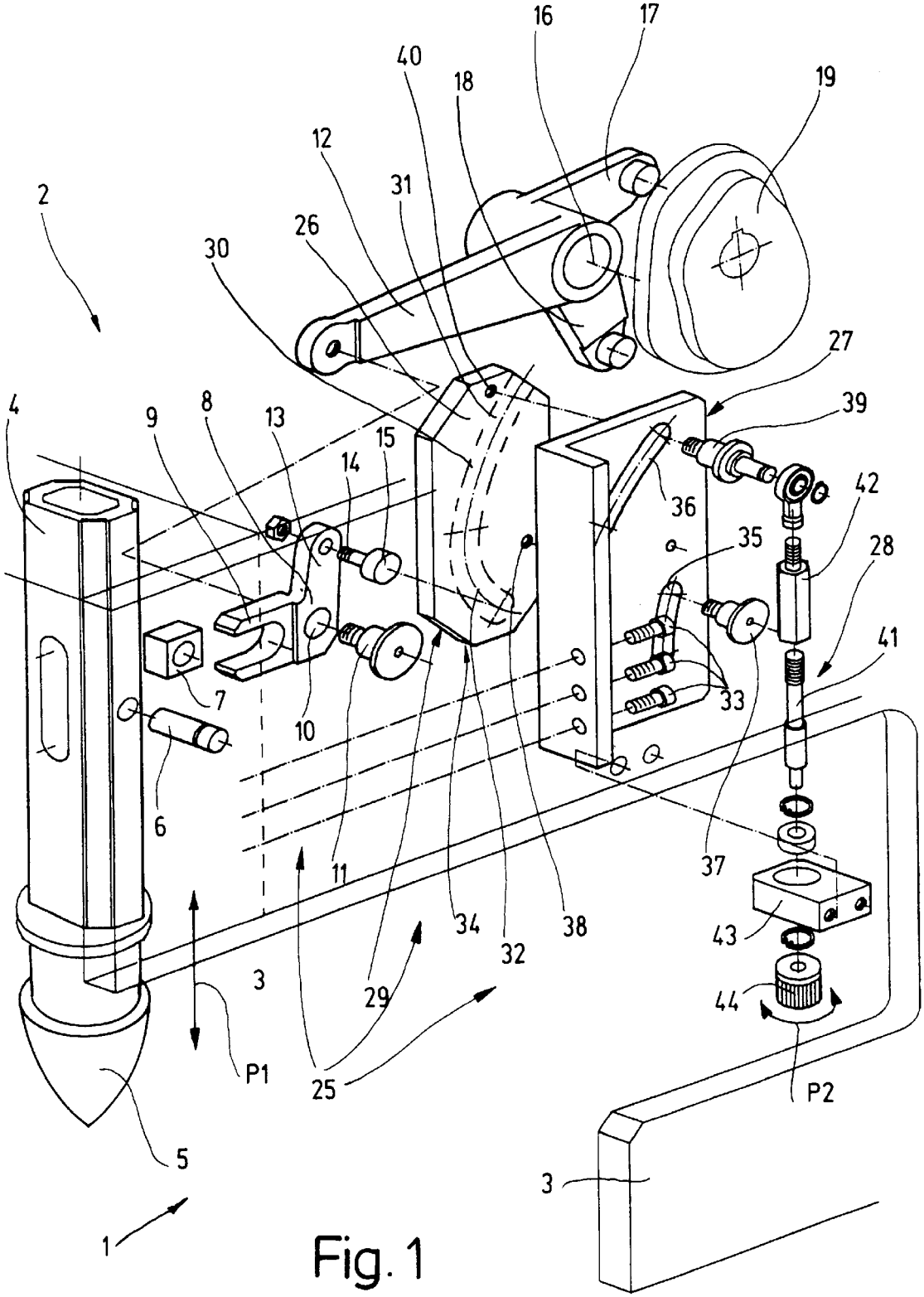
FIG. 1 is a perspective exploded representation of an exemplary embodiment of an ink dabber printing press in accordance with the present invention.

An ink dabber printing press 1 is represented in FIGS. 1 to 7, wherein a printing device 2 is placed in a housing 3. The printing device 2 has a rod 4, which is disposed in an approximately vertical position and is seated so it is displaceable in this direction. An ink dabber 5, which can be moved up and down together with the rod 4 in an approximately vertical direction, is fixed on the lower end of the rod 4 which projects from the housing 3.

The rod 4 is coupled pivotably and displaceably via a pin 6 and an intermediate piece 7 with a setting lever 8. To this end the setting lever 8 has a fork 9, which is engaged by the intermediate piece 7.

The setting lever 8 has a bore 10, through which a holding pin 11 has been passed, which is screwed into a free end of a lever 12. The setting lever 8 is pivotably seated on the drive lever 12 in this manner.

The setting lever 8 furthermore has an arm 13, on which a screw 14 with a head 15 is fastened. The fork 9 and the arm 13 extend at approximately right angles with respect to each other from the bore 10. The head 15 of the screw 14 projects approximately crosswise with respect to the setting lever 8.

The lever 12 is pivotably seated in a manner not shown in detail on a pivot shaft 16. The lever 12 is furthermore coupled via two arms 17, 18 with a cam disk 19 with two control cams, which can be caused to rotate, also in a manner not shown in detail. To this end a drive motor or the like, for example, can be provided, by which the cam disk 19 is driven.

A rotation of the cam disk 19 results in a pivot movement of the lever 12 around the pivot shaft 16, which is transmitted via the setting lever 8 to the rod 4. This causes an up and down movement of the rod 4 as well as of the ink dabber 5 in an approximately vertical direction, as is shown by means of a two-headed arrow P1 in FIG. 1.

As can be seen from FIGS. 2 to 4 or 5 to 7, the ink dabber 5 passes through the following positions in the course of a printing process. The ink dabber 5 initially is in an upper position 21 (position of rest), represented in FIGS. 2 and 5. From there the ink dabber 5 moves downward into an ink pickup position 22, represented in FIGS. 3 and 6. In the ink pickup position 22 the ink dabber 5 is placed on an advanced printing block 20 on which the ink-filled engraving is located. The ink dabber 5 absorbs the ink and then again moves upward. Thereupon the printing block is displaced into a retracted position. Now the ink dabber 5 again moves downward into an ink delivery or printing position 23, 24, represented in FIGS. 4 and 7. There the printing ink is transferred from the ink dabber 5 to an object to be printed, not shown. Thereafter the ink dabber 5 is again moved into the upper position 21 of FIGS. 2 and 5, and the printing process is terminated.

Figure 4:
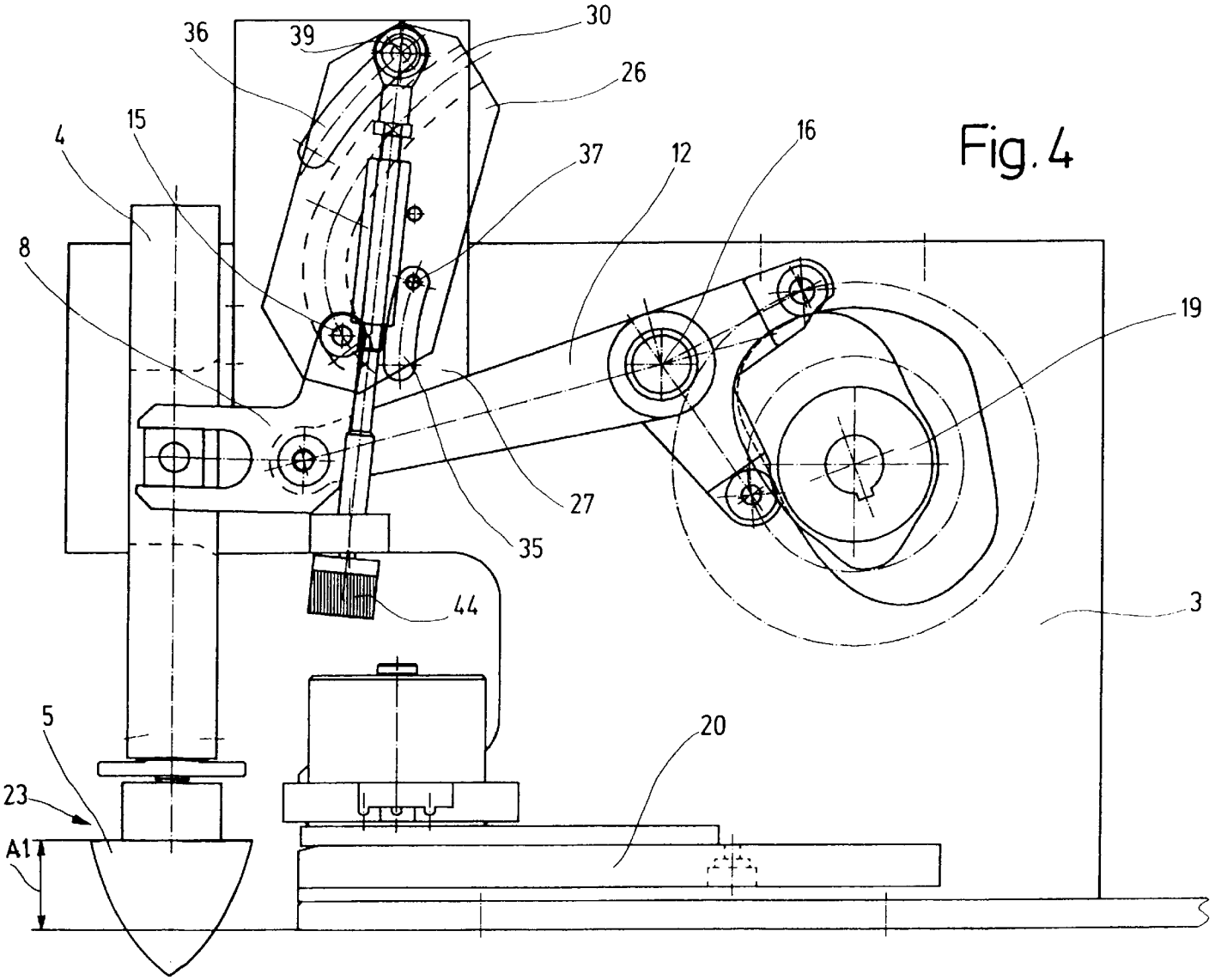
FIG. 4 is a lateral view of the ink dabber printing press of FIG. 1 in a printing position of the ink dabber, wherein the ink dabber printing press is set for printing a low object.
Figure 7:
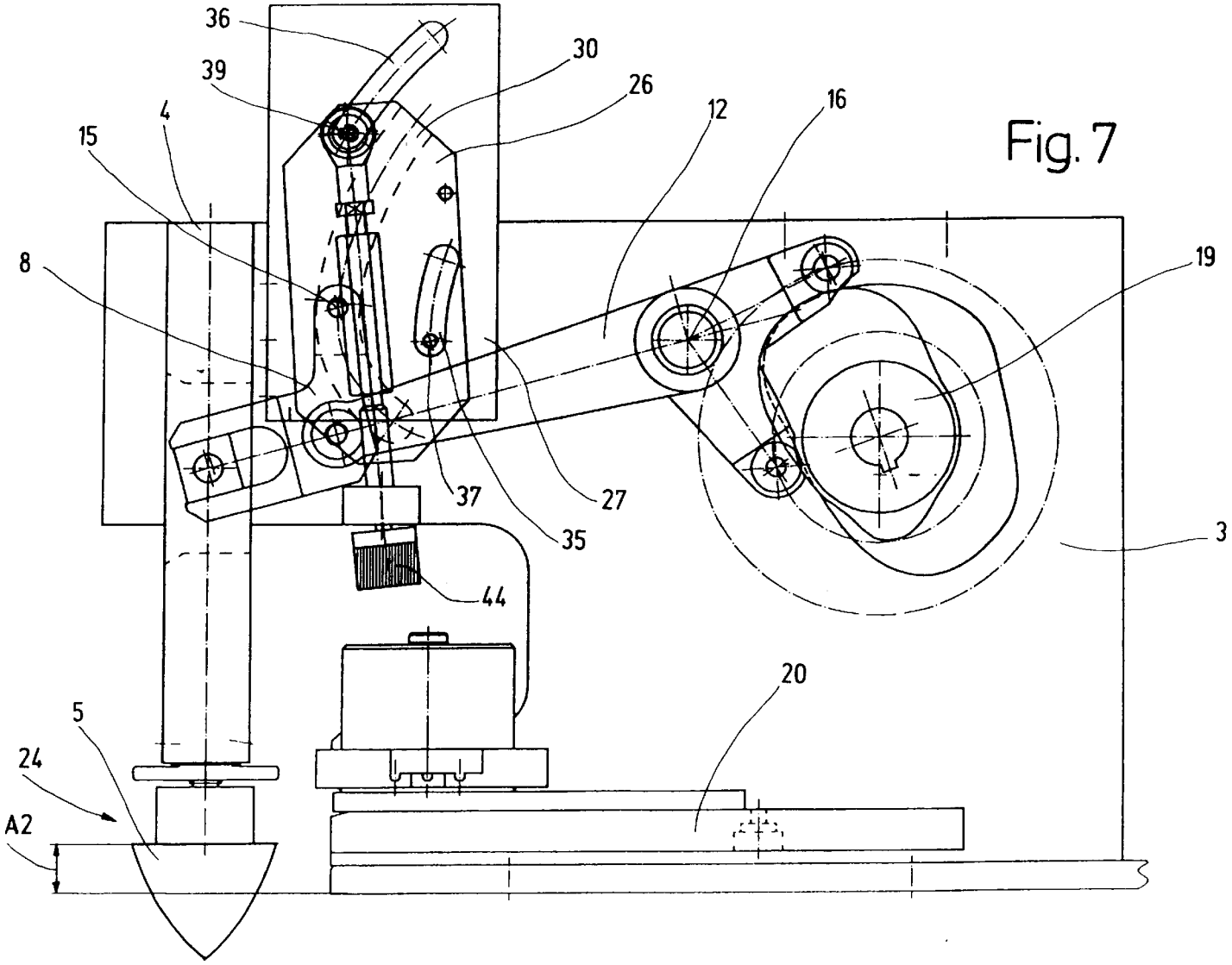
FIG. 7 is a lateral view of the ink dabber printing press of FIG. 1 in a printing position of the ink dabber, wherein the ink dabber printing press is set for printing a low object.

At this point it should already be pointed out that the printing position 23 in FIG. 4 and the printing position 24 in FIG. 7 differ from each other by their respective arrangement in the vertical direction, i.e. their respective height. In this case the printing position 23 in FIG. 4 is disposed higher than the printing position 24 in FIG. 7.

The ink dabber printing press in FIGS. 1 to 7 has means 25 for changing the printing position 23, 24 of the ink dabber 5. Part of the means 25 are the setting lever 8 as well as a displaceable plate 26, a holding device 27 fixed in place and a displacement device 28 fixed in place.

A setting track 30 has been cut into the plate 26 on the side of the plate 26 facing the setting lever 8 and the lever 12. The setting track 30 is provided as a depression in one side of the plate 26. The head 15 of the screw 14, which is held on the arm 13 of the setting lever 8, fits into the setting track 30. The width and depth of the setting track 30 is designed in such a way that the head 15 of the screw 14 can be displaced along the setting track 30. The setting track 30 is coupled in this way with the arm 13 and therefore with the setting lever 12.

The setting track 30 is composed of a circular segment 31 and a curved section 32. The circular segment 31 is arranged concentrically with respect to the pivot shaft 16 of the lever 12 and has a first radius. The curved section 32 adjoins the circular segment 31 and makes a transition from a first radius to a second radius, wherein the second radius is smaller than the first radius. The second radius need not be constant.

The holding device 27 is designed as an angled piece with two approximately level surfaces and is fastened by means of screws 33 to the housing 3. The side of the plate 26 located opposite the side 29 and therefore opposite the setting track 30 faces the holding device 27 and rests against one surface of the holding device 27.

The holding device 27 has two displacement tracks 35, 36, each of which has the approximate shape of a circular segment, and each of which is provided so it passes through the holding device 27. Both displacement tracks 35, 36 are disposed concentrically with respect to the pivot shaft 16 of the lever 12 and in accordance with FIG. 1 have a smaller and a larger inclination in relation to the vertical.

A holding bolt 37, which has been screwed into a thread 38 of the plate 26, passes through the lower displacement track 35. The holding bolt 37 can be displaced along the displacement track 35. A holding bolt 39 passes through the upper displacement track 36 and is screwed into a thread 40 of the plate 26, which can be displaced along the displacement track 36. The plate 26 can be displaced in this way along the holding device 27 in the direction of the displacement tracks 35, 36.

The displacement device 28 has a screw 41 which has been screwed into a threaded sleeve 42. On its end facing away from the threaded sleeve 42, the screw 41 is pivotably fastened on the housing 3 with the aid of a holding element 43. The screw 41 is furthermore provided with a turning knob 44 there, by means of which the screw 41 can be turned into and out of the threaded sleeve 42. The turning knob 44 can be turned in both directions in accordance with the two-headed arrow P2. In the process the screw 41 remains approximately fixed in place in relation to its longitudinal axis, while the threaded sleeve 42 changes its position in the direction of its longitudinal axis. The threaded sleeve 42 is pivotably connected with the holding bolt 39 on its end facing away from the screw 41.

A graduation is provided in a manner not shown in detail on the side of the holding element 43 facing the turning knob 44, by means of which the turned position of the turning knob can be read off or set by a user.

If the screw 41 has only been screwed slightly into the threaded sleeve 42, the holding bolts 37, 39 are respectively at one end of the associated displacement tracks 35, 36, namely at its upper end. This state is represented in FIGS. 2 to 4 and results in the higher printing position 23 of the ink dabber 5, as described below.

Figure 2:
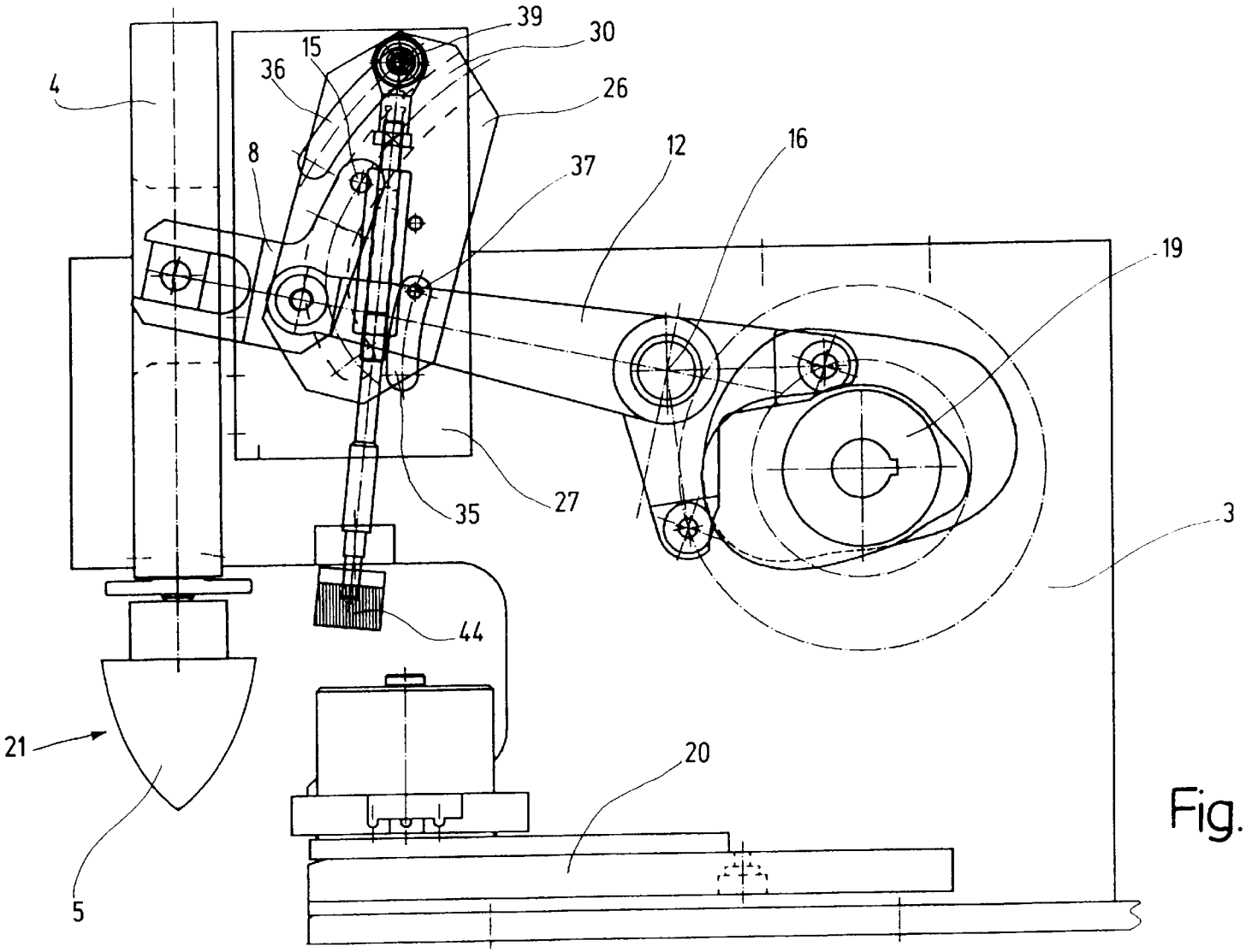
FIG. 2 is a lateral view of the ink dabber printing press of FIG. 1 in an upper position of the ink dabber, wherein the ink dabber printing press is set for printing a tall object.
Figure 3:
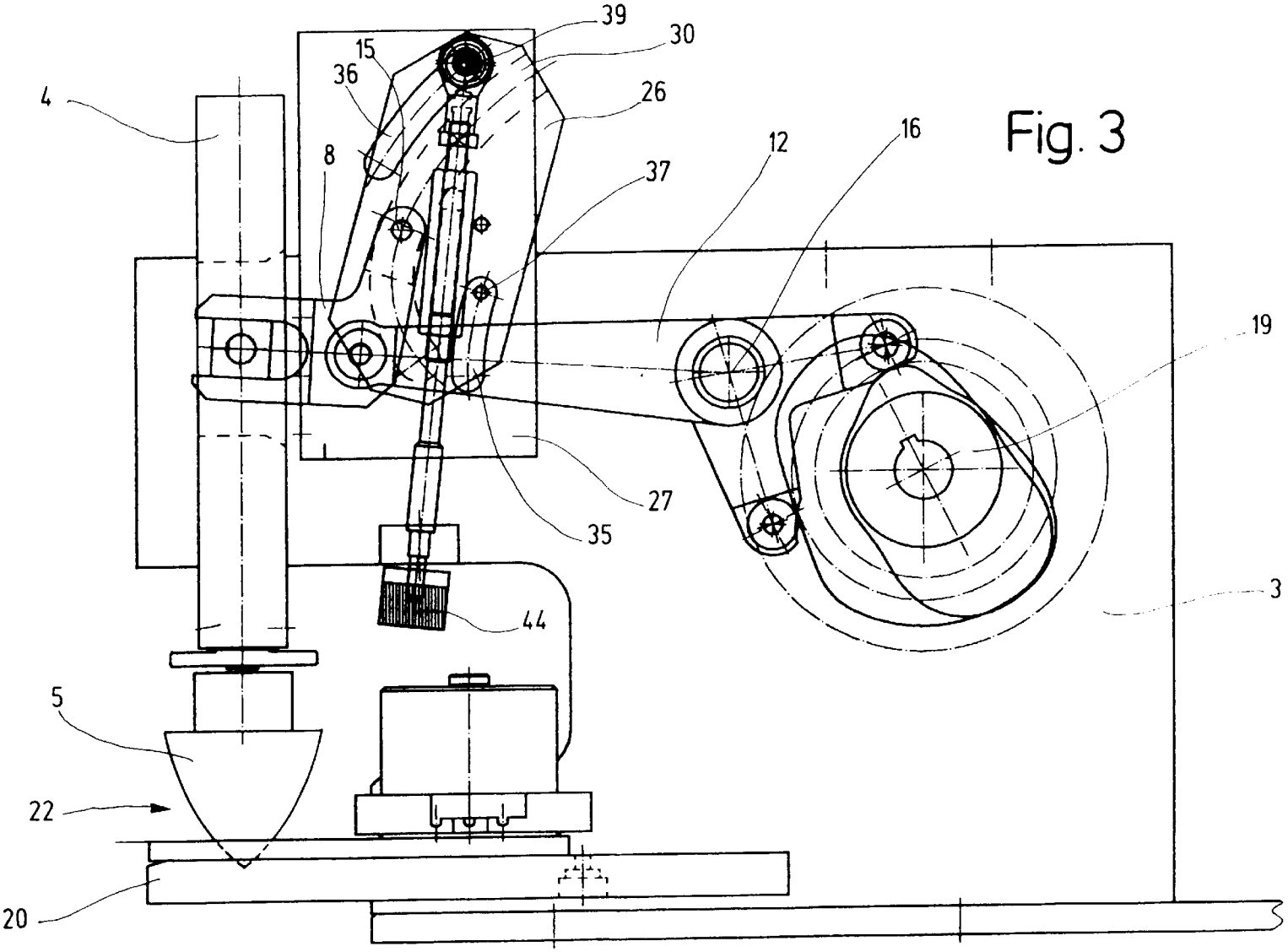
FIG. 3 is a lateral view of the ink dabber printing press of FIG. 1 in an ink pickup position of the ink dabber, wherein the ink dabber printing press is set for printing a tall object.

The arrangement of the two holding bolts 37, 39 respectively at the upper end of the associated displacement tracks 35, 36 causes the plate 26 to be inclined upward and to the right in the direction toward the cam disk 19, according to FIGS. 2 to 4. This in turn causes the setting track 30 to be in a position during a printing operation, in which the head 15 of the screw 14 moves in the curved section 32 and a portion of the adjoining circular segment 31 of the setting track 30, i.e. mainly in the lower area of the setting track 30. In the upper position 21 of the ink dabber 5 in FIG. 2, the head 15 is located in the circular segment 31 of the setting track 30. Similar results apply for the ink pickup position 22 in FIG. 3, wherein the head 15 is just located at the transition from the circular segment 31 to the curved section 32. In the printing position 23 in FIG. 4, however, the head 15 of the screw 14 is located in the curved section 32.

Because of the concentric arrangement of the circular segment 31 in relation to the pivot shaft 16 of the lever 12, the head 15 of the screw 14 is at the same distance from the pivot shaft 16, namely the first radius, in the upper position 21 and the ink pickup position 22. The result of this is that the position of the setting lever 8 in relation to the drive lever 12 is also the same in the upper position 21 and the ink pickup position 22. It can be seen in FIGS. 2 and 3, that in these positions of the ink dabber 5 the fork 9 of the setting lever 8 represents an approximately straight line extension of the drive lever 12.

However, because of the transition from the first radius to the smaller second radius within the curved section 32 of the setting track 30, the distance of the head 15 of the screw 14 from the pivot shaft 16 of the drive lever 12 is reduced. The result of this is that at the time the head 15 passes through the curved section 32, the setting lever 8 is pivoted in relation to the drive lever 12. The printing position 23 of the ink dabber 5 in which the setting lever 8 is at a maximum angle with respect to the drive lever 12 is represented in FIG. 4. There the fork 9 of the setting lever 12 no longer is a straight extension of the lever 12, but is slightly angled with respect to the lever 12.

As can be seen from FIG. 4, the pivoting of the setting lever 8 is directed opposite the movement of the rod 4 downward. Therefore the rod 4 together with the ink dabber 5 cannot move as far downward. This means that the printing position 23 of the ink dabber 5 is changed upward by the pivoting of the setting lever 8, which results in the mentioned higher printing position 23 in FIG. 4. This is indicated in FIG. 4 by a distance A1 between the ink dabber 5 and the base of the ink dabber printing press 1.

If, however, the screw 41 has been screwed deeply into the threaded sleeve 42, the holding bolts 37, 39 are at the respective other end of the associated displacement tracks 35, 36, namely at their lower ends. This state is represented in FIGS. 5 to 7 and results in the lower printing position 24 of the ink dabber 5, as will be described below.

Figure 5:
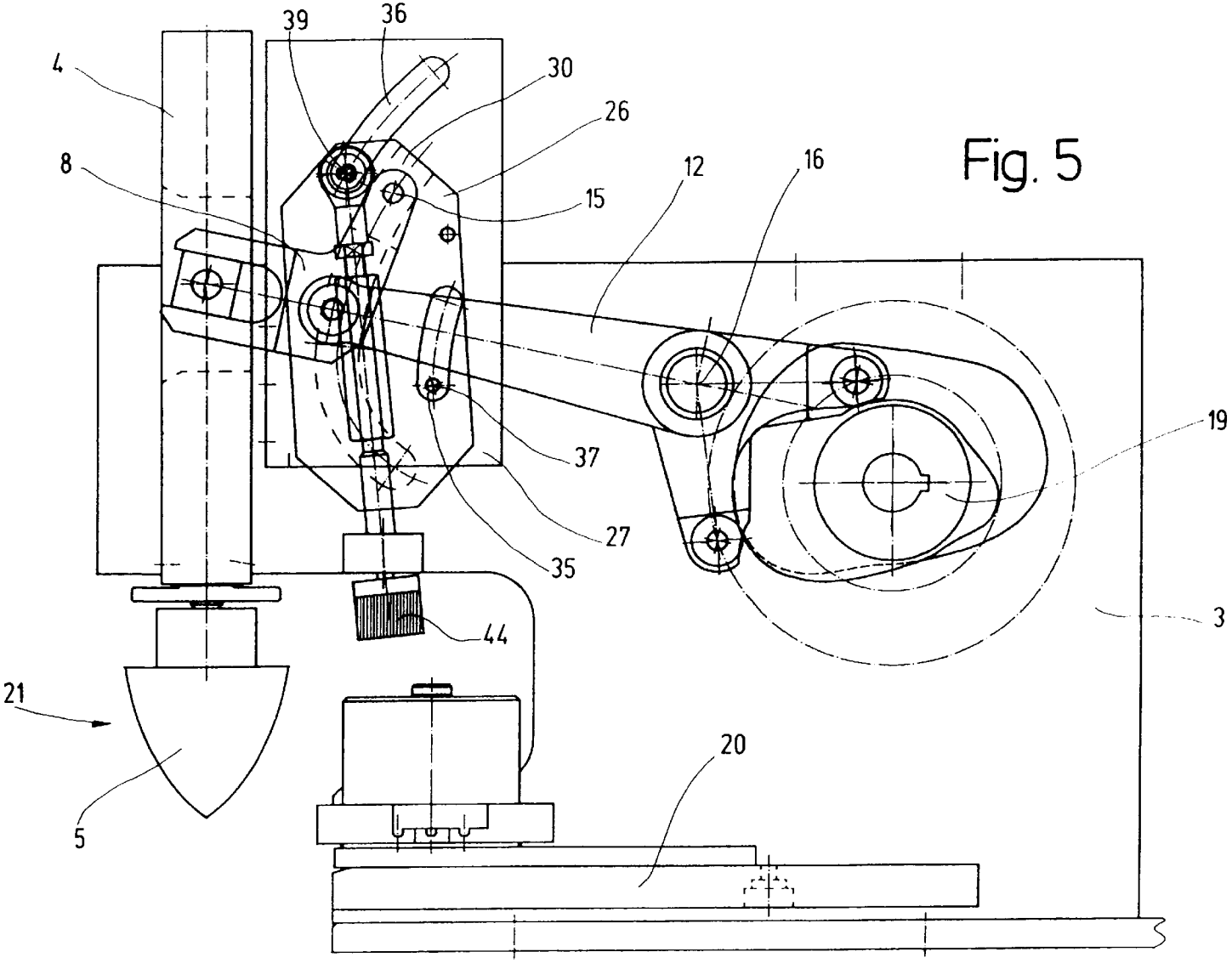
FIG. 5 is a lateral view of the ink dabber printing press of FIG. 1 in an upper position of the ink dabber, wherein the ink dabber printing press is set for printing a low object.
Figure 6:
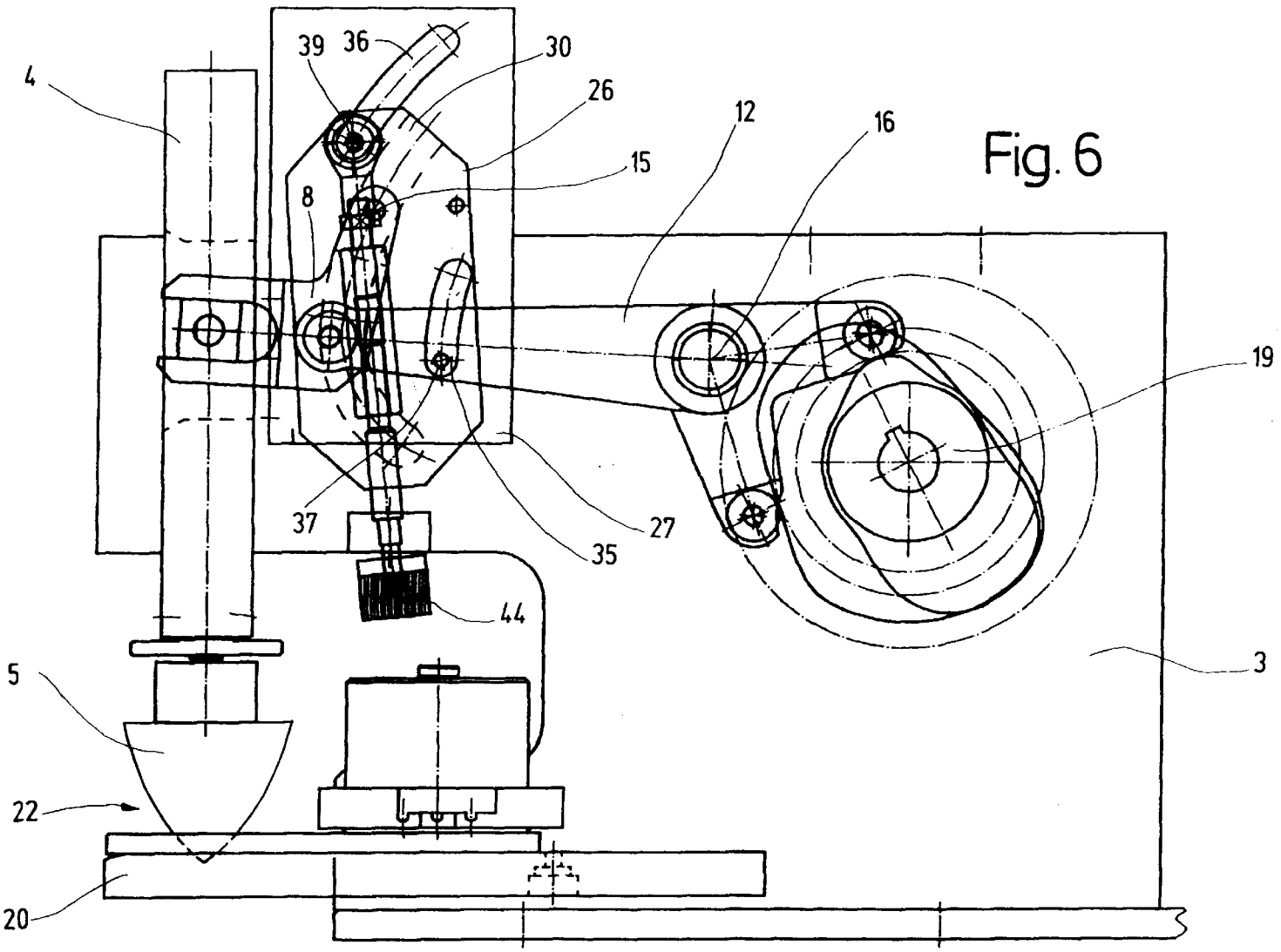
FIG. 6 is a lateral view of the ink dabber printing press of FIG. 1 in an ink pickup position of the ink dabber, wherein the ink dabber printing press is set for printing a low object.

The arrangement of the two holding bolts 37, 39 at respectively the lower ends of the associated displacement tracks 35, 36 has the result that the plate 26 is inclined downward and toward the left in the direction toward the rod 4 in FIGS. 5 to 7. The result of this is, in turn, that the setting track 30 has a position in which the head 15 of the screw 14 moves only in the circular segment 31 of the setting track 30 during the printing process, i.e. mainly in the upper area of the setting track 30. In the upper position 21 of the ink dabber 5 in FIG. 5, the head 15 is in the circular segment 31 of the setting track 30. Similar results apply to the ink pickup position 22 in FIG. 6. In the printing position 24 in FIG. 7 the head 15 of the screw 14 is located just at the transition from the circular segment 31 to the curved section 32.

Because of the concentric arrangement of the circular segment 31 with respect to the pivot shaft 16 of the lever 12, the head 15 of the screw 14 is at the same distance from the pivot shaft 16, namely the first radius, in the upper position 21, the ink pickup 22 and the printing position 24. The result of this is that the position of the setting lever 8 in relation to the drive lever 12 is always approximately the same in the upper position 21, the ink pickup position 22 and the printing position 24. It can be seen from FIGS. 5 to 7 that the fork 9 of the setting lever 8 represents an approximately straight-line extension of the drive lever 12 in all of these positions of the ink dabber 5. In the printing position 24 in FIG. 7 in particular the setting lever 8 is not at an angle with respect to the lever 12.

Therefore the upper position 21 in FIGS. 2 and 5 and the ink pickup positions 22 in FIGS. 3 and 6 match approximately. But the printing position 23 in FIG. 4 differs from the printing position 24 in FIG. 7.

This results from the fact that during the transition of the ink dabber 5 into the printing position 24 in FIG. 7 the head 15 of the screw 14 moves in the circular segment 31 of the setting track 30 and that therefore in contrast to the printing position 23 in FIG. 4 the setting lever 8 is not pivoted. Therefore no movement of the setting lever 8 opposite the direction of movement of the rod 4 takes place in connection with the printing position 24 in FIG. 7, such as is the case in connection with the printing position 23 in FIG. 4.

The result of this is that the printing position 24 in FIG. 7 is arranged lower than the printing position 23 in FIG. 4. This is indicated in FIG. 7 by a distance A2 between the ink dabber 5 and the base of the ink dabber printing press 1, which is less than the distance A1 in FIG. 4.

Thus, the higher printing position 23 of the ink dabber 5 is achieved with the setting of the ink dabber printing press 1 in FIGS. 2 to 4, while with the setting in FIGS. 5 to 7 the lower printing position 24 is achieved. If the objects to be printed are placed on holders, the higher printing position in FIGS. 2 to 4 is suitable for printing taller objects, while the lower printing position 24 in FIGS. 5 to 7 is provided for printing lower objects. In the course of this the holders remain unchanged with respect to their position in relation to the ink dabber printing press 1.

The transition from the higher printing position 23 in FIGS. 2 to 4 to the lower printing position in FIGS. 5 to 7 can be achieved by rotating the turning knob 44 and therefore by turning the screw 41 into or out of the threaded sleeve 42.

Intermediate settings of the printing positions of the ink dabber 5 between the higher printing position 23 in FIG. 4 and the lower printing position 24 in FIG. 7 can be achieved by appropriate intermediate settings of the turning knob 44.

A greater difference between the higher printing position 23 in FIG. 4 and the lower printing position in FIG. 7, in particular a more extensive raising of the higher printing position 23, can be achieved in that the second radius of the setting track 30 is selected to be correspondingly smaller. This results in a higher pivot angle of the setting lever 8 and therefore a smaller downward movement of the rod 4 and therefore of the ink dabber 5.

If instead of the higher printing position 23 in FIG. 4 the lower printing position 24 in FIG. 7 is to be changed, this can be achieved in that the curved section 32 of the setting track 30 makes a transition from a smaller radius to a larger radius. In contrast to the description up to now, the setting lever 8 is not pivoted upward because of this, but downward. The result of this is that the downward movement of the rod 4 and therefore of the ink dabber 5 is increased by the setting lever 8.

What is claimed is:

1. An ink dabber printing press, including:

a printing device; a printing block on which an ink-filled engraving is located; and an ink dabber mounted to said printing device for movement in a printing position, toward and away from an object to be printed, and for movement in an ink pickup position toward and away from said printing block, wherein said printing device has means for changing the movement of said ink dabber in the printing position, and wherein the movement of said ink dabber in the ink pickup position is fixed.

2. The ink dabber printing press as defined in claim 1, wherein said printing device further has a pivotably mounted drive lever, a drivable cam disk coupled to said pivotably mounted drive lever, and a rod on which said ink dabber is mounted for up and down movement, and wherein said means for changing the printing position has a setting lever which is pivotably seated on said drive lever and is coupled to said rod.

3. The ink dabber printing press as defined in claim 2, wherein said means for changing the printing position further has a setting track, and wherein said setting lever has an arm which is coupled with said setting track.

4. The ink dabber printing press as defined in claim 3, wherein said means for changing the printing position further has a plate provided with said setting track.

5. An ink dabber printing press, including: a printing device; a pivot shaft; and an ink dabber mounted to said printing device for movement into a printing position, said printing device having: means for changing the printing position; a pivotably mounted drive lever; a drivable cam disk coupled to said pivotably mounted drive lever; and a rod on which said ink dabber is mounted for up and down movement, wherein:

said means for changing the printing position has a setting lever which is pivotably seated on said drive lever and is coupled to said rod and a setting track;

said setting lever has an arm which is coupled with said setting track;

said setting track including a circular segment defining a first radius and a curved section which adjoins the circular segment and provides a transition from the first radius to a second radius;

said circular segment is arranged concentrically relative to said pivot shaft; and said second radius is smaller than said first radius.

6. An ink dabber printing press, including: a printing device; and an ink dabber mounted to said printing device for movement into a printing position, wherein: said printing device has means for changing the printing position; a pivotably mounted drive lever, a drivable cam disk coupled to said pivotably mounted drive lever, and a rod on which said ink dabber is mounted for up and down movement; said means for changing the printing position has a setting lever which is pivotably seated on said drive lever and is coupled to said rod; and a setting track; said setting lever having an arm which is coupled with said setting track; and said setting track has a circular segment defining a first radius and a curved section which adjoins the circular segment and provides a transition from the first radius to a second radius.

7. An ink dabber printing press, including: a printing device; a holding device; and an ink dabber mounted to said printing device for movement into a printing position, wherein:

said printing device has means for changing the printing position, a pivotably mounted drive lever, a drivable cam disk coupled to said pivotably mounted drive lever, and a rod on which said ink dabber is mounted for up and down movement;

said means for changing the printing position has a setting lever which is pivotably seated on said drive lever and is coupled to said rod, a setting track and a plate provided with said setting track;

said setting lever has an arm which is coupled with said setting track;

said plate is displaceably held on said holding device; and said holding device is fixed in place.

8. The ink dabber printing press as defined in claim 7, wherein said holding device has at least one displacement track disposed therein, and wherein said at least one displacement track is coupled with said plate.

9. The ink dabber printing press as defined in claim 8, further including: a pivot shaft for pivotably mounting said drive lever, wherein said at least one displacement track has a circular segment which is disposed concentrically with respect to said pivot shaft.

10. The ink dabber printing press as defined in claim 7, further including: a displacement device which is fixed in place, and by means of which said plate can be displaced relative to said holding device.

11. The ink dabber printing press as defined in claim 10, wherein said displacement device is provided with a graduation.

* * * * *